US007749144B2

(12) United States Patent
Hammer

(10) Patent No.: US 7,749,144 B2
(45) Date of Patent: Jul. 6, 2010

(54) ADJUSTABLE ABDOMINAL EXERCISE MACHINE

(75) Inventor: Rodney Hammer, Lewiston, UT (US)

(73) Assignee: Icon IP, Inc., Logan, UT (US)

( * ) Notice: Subject to any disclaimer, the term of this patent is extended or adjusted under 35 U.S.C. 154(b) by 200 days.

(21) Appl. No.: 11/531,999

(22) Filed: Sep. 14, 2006

(65) Prior Publication Data

US 2007/0129225 A1 Jun. 7, 2007

Related U.S. Application Data

(60) Provisional application No. 60/737,437, filed on Nov. 16, 2005.

(51) Int. Cl.
*A63B 26/00* (2006.01)

(52) U.S. Cl. ..... 482/142; 482/140; 482/121

(58) Field of Classification Search ..... 482/142, 482/121–130, 148, 904
See application file for complete search history.

(56) References Cited

U.S. PATENT DOCUMENTS

| | | | | | |
|---|---|---|---|---|---|
| 3,491,998 | A | * | 1/1970 | Lyon | 482/142 |
| 3,589,715 | A | | 6/1971 | Mark et al. | |
| D224,422 | S | | 7/1972 | Beach | |
| 3,767,190 | A | | 10/1973 | Biggerstaff | |
| 4,202,581 | A | * | 5/1980 | Fleishman | 297/440.13 |
| 4,390,204 | A | * | 6/1983 | Fleishman | 297/16.1 |
| 4,517,966 | A | | 5/1985 | Von Othegraven | |
| 4,533,174 | A | * | 8/1985 | Fleishman | 297/16.1 |
| 4,550,950 | A | * | 11/1985 | Fleishman | 297/440.13 |
| 4,569,496 | A | * | 2/1986 | Fleishman | 248/165 |
| 5,154,685 | A | | 10/1992 | Chen | |
| 5,681,250 | A | | 10/1997 | Hoover et al. | |
| 5,860,897 | A | * | 1/1999 | Gilbert et al. | 482/130 |
| 5,902,220 | A | | 5/1999 | Lin | |
| 6,022,303 | A | | 2/2000 | Abdo | |
| D432,600 | S | | 10/2000 | Szabo et al. | |
| 6,248,047 | B1 | * | 6/2001 | Abdo | 482/130 |
| 6,394,938 | B1 | * | 5/2002 | Tornabene | 482/142 |
| 6,716,144 | B1 | * | 4/2004 | Shifferaw | 482/123 |
| 6,997,857 | B2 | * | 2/2006 | Bowman et al. | 482/148 |
| 7,086,992 | B2 | * | 8/2006 | Bowman et al. | 482/51 |
| 7,137,933 | B2 | * | 11/2006 | Shifferaw | 482/121 |
| 7,381,168 | B2 | * | 6/2008 | Bowser | 482/121 |
| 2003/0050156 | A1 | * | 3/2003 | Tornabene | 482/123 |
| 2005/0143233 | A1 | * | 6/2005 | Shifferaw | 482/140 |
| 2007/0213185 | A1 | * | 9/2007 | Habing | 482/100 |

* cited by examiner

*Primary Examiner*—Lori Baker
(74) *Attorney, Agent, or Firm*—Madson IP, P.C.

(57) ABSTRACT

An exercise machine for strengthening the abdominal and back muscles of a user has a frame that includes a front leg pivotally connected to a rear leg. The exercise machine also includes a seat and a backrest for supporting the back of a user during an exercise routine that is adjustably positioned and secured with respect to the seat. The backrest is adjustably flexible in order to provide resistance to the movement of a user in order to help strengthen the user's abdominal and back muscles. The backrest includes handles to facilitate engagement between the backrest and the user and to encourage the user to move against the adjustable resistance provided by the backrest. The exercise machine includes a non-use, storage mode that facilitates storage of the exercise machine.

15 Claims, 5 Drawing Sheets

ADJUSTABLE ABDOMINAL EXERCISE MACHINE

RELATED APPLICATIONS

This application is related to and claims priority from Provisional U.S. Patent Application Ser. No. 60/737,437 filed Nov. 16, 2005, for an Adjustable Abdominal Exercise Machine, with inventor Rodney Hammer, which is incorporated herein by reference.

BACKGROUND OF THE INVENTION

This invention relates generally to exercise machines for exercising a user's abdominal and back muscles. Exercise machines generally provide resistance to the movement of a user in order to strengthen muscles of the user's body. However, conventional techniques, such as sit-ups, crunches, or roman chair hyperextension exercises, use the body's own weight to exercise the abdominal and back muscles of the user. Consequently, the conventional techniques fail to provide support and controlled resistance to the movements of a user, which can be particularly problematic for out-of-shape or obese users. Specifically, conventional techniques lack ways to control the resistance and motion of the user to prevent injury from an uncontrolled movement or from overloaded and strained muscles.

Of the available exercise machines that may be used to exercise and strengthen a user's abdominal and back muscles by providing resistance to the user's movements, many only permit certain portions of the abdominal and back muscles to be exercised, which leaves other portions unexercised and typically uneven in strength. This often leads to injury. Furthermore, many of these machines do not support the user's back during the exercise, which may lead to hyperextension injuries. These exercise machines also may not be capable of adjusting the resistance to a user's movements or adjusting the position of the user to provide more difficult exercise routines. Additionally, many currently available exercise machines take up large amounts of usable space when not in use, which prevents them from being conveniently located in the user's residence.

Accordingly, a need exists for an exercise machine that permits the position of a user to be adjusted for more or less difficulty during an exercise routine. A need exists for an exercise machine that supports the back to prevent injury and uncontrolled movements. Additionally, a need exists for an exercise machine that offers the ability to change the resistance to the motion of the user in exercising their abdominal and back muscles. Furthermore, a need exists for an exercise machine that does not occupy an excessive amount of room when it is not in use and that permits easy and convenient storage.

BRIEF SUMMARY OF THE INVENTION

The apparatus and system of the present invention has been developed in response to the present state of the art, and in particular, in response to the problems and needs in the art that have not been fully solved by currently available exercise machines. Thus, the present invention provides an exercise machine that supports and provides resistance to the movements of a user while performing abdominal, oblique, and back exercises.

An embodiment of an exercise apparatus for use on a base surface by a user is disclosed. The exercise apparatus includes a foldable frame for supporting a seat above the base surface.

The foldable frame is moveable between an exercise mode and a storage mode. The exercise apparatus also includes a moveable backrest. The moveable backrest includes a resilient spine member. The moveable backrest also includes a first end connected to the frame and a second end that is freely moveable. The backrest is disposed to provide support to the user's back during movement of the backrest.

Another embodiment of an exercise apparatus for use on a base surface by a user is disclosed. The exercise apparatus includes a foldable frame for supporting a seat above the base surface. The foldable frame is moveable between an exercise mode and a storage mode. The frame includes a front leg. The frame also includes a rear leg that is pivotally attached to the front leg such that the rear leg extends from the front leg at an angle. The exercise apparatus also includes a moveable backrest. The moveable backrest includes a resilient spine member. The moveable backrest also includes a first end connected to the frame and a second end that is freely moveable. The backrest is disposed to provide support to the user's back and neck during movement of the backrest.

A further embodiment of an exercise apparatus for use on a base surface by a user is disclosed. The exercise apparatus includes a frame for supporting a seat above the base surface. The frame includes a front leg. The frame also includes a rear leg. The rear leg is pivotally attached to the front leg by a pin joint such that the rear leg extends from the front leg at an angle in the range of about 100 degrees to about 110 degrees. The rear leg also includes at least one attachment ring for connecting a resistance band to the exercise apparatus. The exercise apparatus also includes a moveable backrest. The moveable backrest includes a resilient spine member. The moveable backrest also includes a first end connected to the frame and a second end that is freely moveable. The moveable backrest may also include at least one elongate flexible member. Each elongate flexible member comprises flexible material to provide resistance to the movement of the user. The backrest is disposed to provide support to the user's back and neck during movement of the backrest. The exercise machine further includes a bracket that is pivotally connected to the backrest. The bracket includes at least one aperture. The bracket is attached to the rear leg using a pin through one of the apertures. The bracket is also used to adjust the position of the backrest connected to the rear leg. At least one of the apertures is configured to position the backrest in a substantially non-vertical position. The exercise apparatus also includes at least one pad. Each pad captures the resilient spine member and may capture the one or more elongate flexible members. One of the pads is attached to the bracket. The exercise machine further includes a handle that is disposed near the second end of the backrest.

In some embodiments, the second end of the backrest twists with respect to the first end of the backrest if acted upon by a threshold torsional force. In other embodiments, the second end of the backrest moves forward or backward with respect to the first end of the backrest if acted upon by a threshold, forward or backward, force. In further embodiments, the second end of the backrest moves side to side with respect to the first end of the backrest if acted upon by a threshold side to side force. In still further embodiments, the second end of the backrest moves forward and backward or side to side while twisting with respect to the first end of the backrest if acted upon by a threshold forward, backward, or side to side force and a threshold torsional force.

In some embodiments, the exercise apparatus further includes a bracket connected to the frame that includes at least one aperture. The bracket is used to adjust the position of the backrest with respect to the frame. In still further embodiments, at least one of the apertures is located to position the backrest in a substantially non-vertical position. In some embodiments, each of the apertures corresponds to a position that represents a desired difficulty such that the user can select a position and thereby select a desired difficulty. In further embodiments, one of the apertures is located to position the backrest in a substantially horizontal position (i.e., generally parallel to the base surface). In still further embodiments, one of the apertures is located to position the backrest in a position that is below horizontal (i.e., generally between the horizontal position and parallel to the rear leg).

In some embodiments, the exercise apparatus further includes one or more flexible members that may be disposed adjacent to the resilient spine member and captured by the backrest such that each added flexible member provides a different resistance to the user's movements than the resilient spine member alone. In further embodiments, the exercise apparatus also includes at least one pad, which captures the resilient spine member. In still further embodiments, the exercise apparatus further includes a handle that is disposed near the second end of the moveable backrest.

These and other features of the present invention will become more fully apparent from the following description and appended claims, or may be learned by the practice of the invention as set forth hereinafter.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the exercise machine of the present invention, as represented in FIGS. 1 through 5, is not intended to limit the scope of the invention, as claimed, but is merely representative of presently preferred embodiments of the invention.

The phrases "connected to," "coupled to," and "in communication with" refer to any form of interaction, though not necessarily direct interaction, between two or more entities, including mechanical, electrical, magnetic, electromagnetic, and thermal interaction. For example, a part or piece may intervene between two pieces that are "connected to," "coupled to," and "in communication with" each other. The phrase "attached to" refers to a form of mechanical coupling that restricts relative translation or rotation between the attached objects. The phrases "pivotally attached to" and "slidably attached to" refer to forms of mechanical coupling that permit relative rotation or relative translation, respectively, while restricting other relative motion. The phrase "directly attached to" refers to a form of attachment by which the attached items are either in direct contact, or are only separated by a single fastener, adhesive, or other attachment mechanism. The term "abutting" refers to items that are in direct physical contact with each other, although the items may not be attached together.

Figure 1:
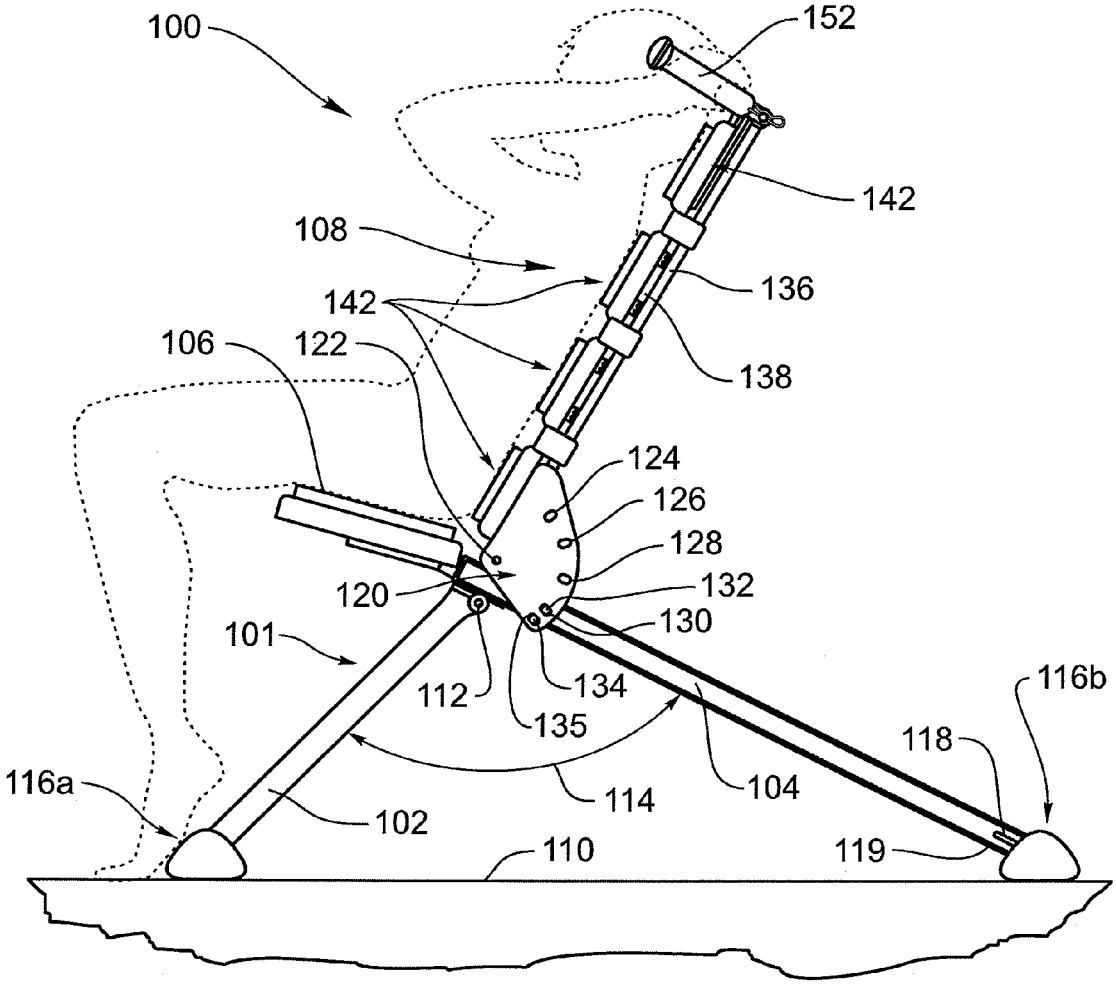
FIG. 1 is a side elevation view of an embodiment of an exercise machine showing a user in phantom lines.

FIG. 1 is a side elevation view of an embodiment of an exercise machine 100 showing a user in phantom lines. In the illustrated embodiment, the exercise apparatus 100 has a frame 101 that includes a front leg 102 and rear leg 104 for disposing a seat 106 and a moveable backrest 108 above a base surface 110, such as the floor of a building. The front leg 102 may be pivotally attached to the rear leg 104 by a pin 112. Of course, the front leg 102 and the rear leg 104 may be pivotally attached in other ways.

In the exercise position, the front leg 102 may extend from the rear leg 104 at angle 114. The angle 114 may range from about 90 degrees to about 130 degrees. However, the exercise apparatus 100 may still operate at angles 114 outside these stated ranges. In the present embodiment, the front leg 102 extends from the rear leg 104 at an angle 114 in the range of about 100 degrees to about 110 degrees.

As shown, the front leg 102 and the rear leg 104 may each be attached to feet 116*a*, 116*b*. The feet 116*a*, 116*b* may extend on both sides of the exercise apparatus 100 to stabilize and provide a sturdy base for the exercise apparatus 100. The rear foot 116*b*, in the present embodiment, is attached to the rear leg 104 and includes attachment rings 118 for connecting resistance bands (shown in FIG. 2) to the exercise apparatus 100. The attachment rings 118 may be connected to other parts of the exercise apparatus 100. In the present embodiment, the attachment rings are welded to the feet 116*a*, 116*b*. In other embodiments, the attachment rings 118 may be integrally formed with the feet 116*a*, 116*b* or may be attached using other techniques. The front foot 116*a*, in the present embodiment, is attached to the front leg 102.

The resistance bands may be used with the exercise apparatus 100 to strengthen the arms, chest, and shoulders. For example, the resistance bands may permit a user to perform exercises such as Bench Press, Military Press, Chest Fly, Bicep Curl, Lateral Fly, Front Raise, Shoulder Press, and other exercises.

In the present embodiment, the seat 106 is connected to and extends from the rear leg 104. In other embodiments, the seat 106 may be connected to another portion of the exercise apparatus 100, such as the front leg 102, the bracket 120, etc. The seat may be padded for added comfort and may include a non-slip material to prevent a user from slipping off of the exercise apparatus 100 while exercising.

The backrest 108 may be pivotally attached to the rear leg 104 by a bracket 120. Specifically, in the present embodiment, the bracket 120 is pivotally coupled to the rear leg 104 by a bolt 122 and the backrest 108 is attached to the bracket 120.

The bracket 120 may include at least one aperture 124, 126, 128, 130. In the present embodiment, the bracket 120 includes a first aperture 124, a second aperture 126, a third aperture 128, and a fourth aperture 130 that may be used to position the backrest 108. Thus, as the bracket 120 is adjusted and secured to different positions, the backrest 108 may also be adjusted to a plurality of use positions to provide varying levels of difficulty in exercising the core muscle groups.

Figure 3:
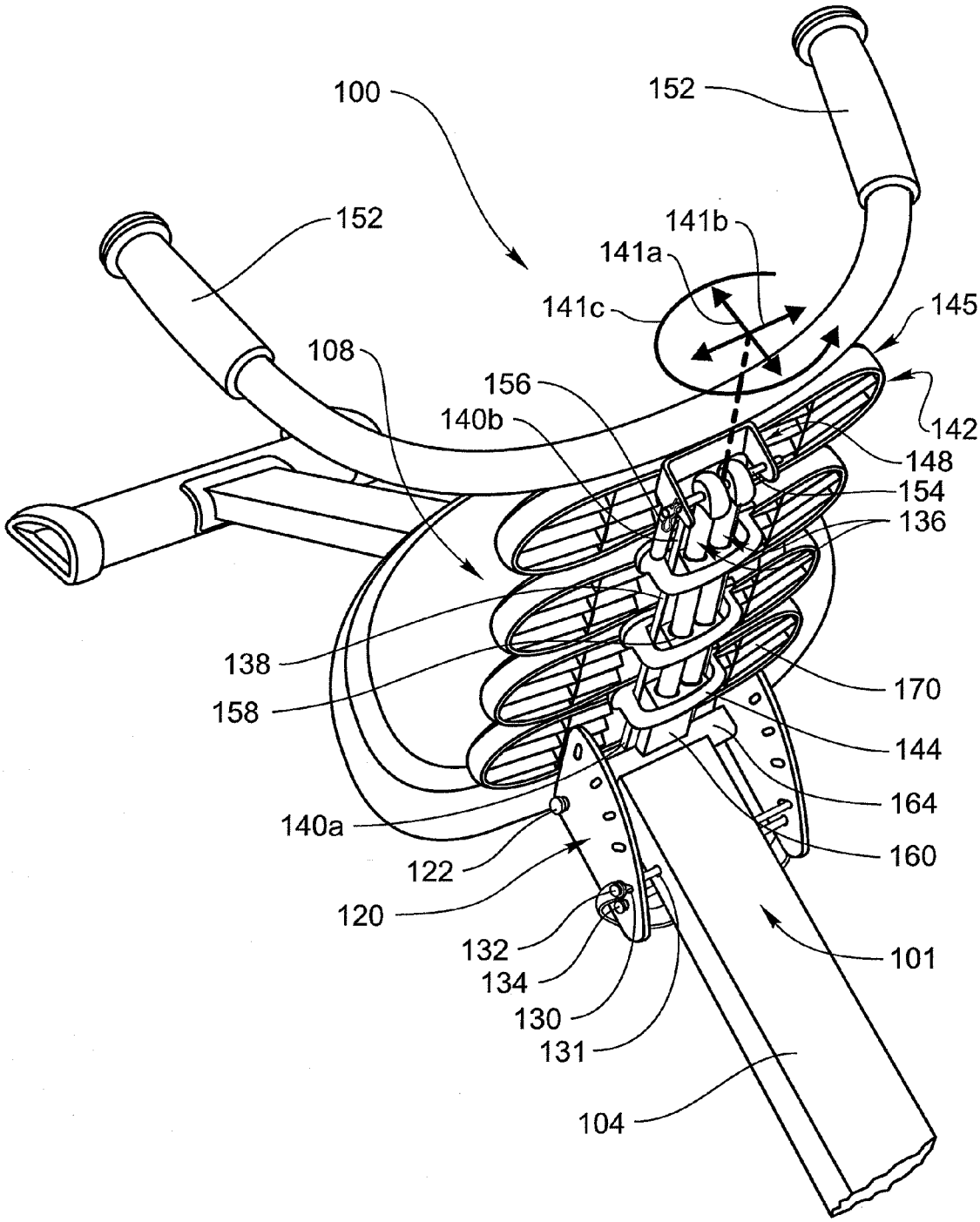
FIG. 3 is a top perspective sectional view of the exercise machine of FIG. 1.

A pin 132 may be positioned to extend through the desired aperture 124, 126, 128, 130 and a hole (shown in FIG. 3) extending through the rear leg 104 to secure the backrest 108 in a desired position. As shown, the pin 132 extends through the fourth aperture 130 and the rear leg 104 to secure the backrest 108 in the position shown. The pin 132 may be tethered to the frame, as shown in FIG. 3.

To prevent the backrest 108 from being pivoted too far forward, the bracket 120 may include a stop pin 134 that is inserted through a stop pin aperture 135. When the backrest 108 is moved to its forward-most position, the stop pin 134 may abut a bottom surface 119 of the rear leg 104. The stop pin 134 may be welded into place or may be fastened in position.

The exercise apparatus 100 may include a resilient spine member 138. The resilient spine member 138 may support the user's back and will be discussed in more detail in FIG. 2. The backrest 108 may also include flexible members 136. The flexible members 136 and the resilient spine member 138 may be captured by a series of pads 142. Handles 152 may extend on both sides of the backrest 108 to permit a user to comfortably grip the handles 152 to exercise their abdominal and back muscles.

Figure 2:
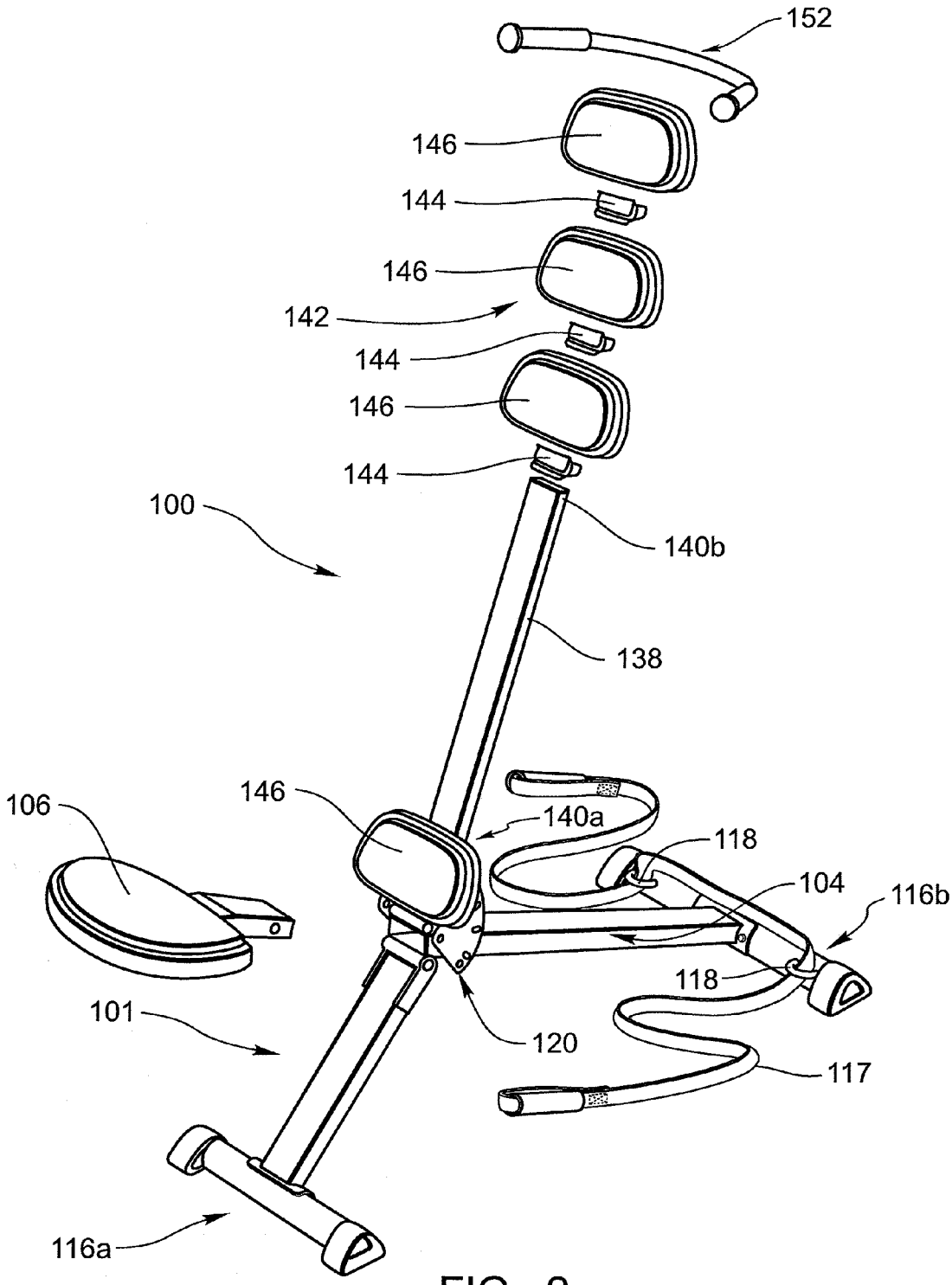
FIG. 2 is a partially exploded perspective view of an embodiment of the exercise machine shown in FIG. 1.

FIG. 2 is a partially exploded perspective view of an embodiment of the exercise machine 100 shown in FIG. 1. The assembly of the series of pads 142 over the resilient spine member 138, in the embodiment of the exercise machine 100 of FIG. 1, is generally illustrated.

The resilient spine member 138 may include a first end 140*a* and a second end 140*b*. The first end 140*a* may be connected to the frame 101 by fasteners, welding, or any other connection method. In the present embodiment, the first end 140*a* is connected using fasteners (not shown) to the bracket 120. The bracket 120 may be connected to the rear leg 104 of the frame 101. In some embodiments, the first end 140*a* may be directly connected to the frame 101, rather than indirectly connected to the frame 101 through the bracket 120, as in the present embodiment, or may use some other type of indirect connection. The second end 140*b* of the resilient spine member 138 is freely movable in any direction except toward the first end 140*a*.

The series of pads 142 may be made of plastic, composite material, metal, foamed plastic, or any other suitable material. The series of pads 142 may be connected to or disposed over the resilient spine member 138. In the present embodiment, only the bottommost and topmost pads 142 are connected to the resilient spine member 138, while the remaining pads 142 are slidably attached to the resilient spine member 138. For example, one of the pads 142 may also be attached to the bracket 120 to prevent the bracket 120 from abutting and irritating the back of a user. Attaching one of the pads 142 to the bracket 120 may also help to isolate certain muscle groups during an exercise routine. The pad 142 may be attached to the bracket 120 by fasteners (not shown).

Spacers 144 may be included with the series of pads 142. The spacers 144 may be used to attach the pads 142 to the resilient spine member 138 and to separate the series of pads 142. The spacers 144, in the present embodiment, are connected to a structural portion (not shown) of the pads 142. Cushioned portions 146 may be disposed to provide a comfortable surface to engage a user's back.

The seat 106 may be connected to the frame 101. In the present embodiment, the seat 106 is bolted to the frame 101. The seat 106 may be integrally formed with, welded to, or otherwise connected to the frame 101 using any connecting method.

FIG. 2 also illustrates the resistance bands 117 inserted through the attachment rings 118. The resistance bands 117 may be connected to the frame 101 using any method. The resistance bands 117 may be made of surgical tubing, elastic bands, springs, or other materials that may provide resistance to a user's movement. The resistance bands 117 may be threaded as shown in FIG. 2 or each band 117 may be separately attached to an attachment ring 118. Multiple resistance bands 117 may also be used to provide added resistance.

FIG. 3 is a top perspective sectional view of the exercise machine 100 of FIG. 1. In the illustrated embodiment, the backrest 108 is adjusted to an exercise position that corresponds with the fourth aperture 130. The bracket 120 may be connected to the rear leg 104 of the frame 101 by the bolt 122. A sleeve 164 of the rear leg 104 may permit the bolt 122 to pivotally attach the bracket 120 to the rear leg 104. The bracket 120 may be secured in position by inserting the pin 132 through the fourth aperture 130 and the hole 131 through the rear leg 104. The pin 132 may be tethered to the exercise apparatus 100. The stop pin 134 is also shown.

FIG. 3 generally illustrates forces 141*a*, 141*b*, 141*c* of various types that the user may apply to the backrest 108. The resilient spine member 138 may provide resistance to these forces (i.e., forward and backward forces 141*a*, side to side forces 141*b*, and torsional forces 141*c*) applied by the user in order to strengthen the user's abdominal, lower back, and upper back muscles.

To adjust the resistance of the forces 141*a*, 141*b*, 141*c* created by the user's movement of the backrest 108, one or more additional flexible members 136 may be added or removed from the backrest 108. The flexible members 136 may provide support to the user's back and may provide resistance to forward and backward forces 141*a*, side to side forces 141*b*, and torsional forces 141*c* in order to strengthen the user's the abdominal, lower back, and upper back muscles.

The flexible members 136 may be elongated members made of a resilient material and/or may have a resilient structure. For example, the flexible member 136 may be made of nylon, fiberglass, plastics, metal, and/or composite materials and may be shaped as a rod, beam, leaf spring, or coiled spring. By varying the materials and/or design of the flexible member 136 the backrest 108 may provide different levels of resistance to the movements of a user.

In the present embodiment, the flexible members 136 have generally the same resistance characteristics. For example, the flexible members 136 may include a circular profile in order to provide relatively uniform resistance to any direction a force may be applied to the backrest 108. Of course, other profiles may be used in order to increase resistance in desired directions. Alternatively, the flexible members 136 that are used may have different resistance characteristics.

The flexible members 136 may extend through loops 158 of the spacers 144 of the pads 142 and may be attached to an attachment structure 148 by the pin 154 and secured by the cotter pin 156. The flexible members 136 may be secured to the backrest 108 in any fashion and may or may not be removable. In the present embodiment, the flexible members 136 may extend into a pocket 160 of the bracket 120. Specifically, the proximal end (not shown) of the flexible member 136 is secured within the pocket 160 by fasteners (not shown).

Though, in the present embodiment, two flexible members 136 are used, in other embodiments, only one flexible member 136 may be used. In further embodiments, more than two flexible members 136 may be used. In many embodiments, the user may select the number and resistance characteristics of the flexible members 136 used to customize the user's exercise routine.

FIG. 3 also generally illustrates the structure of the pads 142 in more detail. For example, the pads 142 may include structural portions 145. The structural portions 145 may be disposed to permit the backrest 108 to flex while providing strength to the pads 142. For example, the structural portions 145 of the pads 142 may include stiffening structures 170 that help the backrest 108 support a user's back. In the present embodiment, the stiffening structures 170 are webbing molded into the structural portions 145 of the pads 142.

The series of pads 142 may include the attachment structure 148 for attaching the pads 142 to the first end 140*a* of the resilient spine member 138 and to the handles 152 of the backrest 108. The structural portions 145 may be molded over the attachment structure 148 to securely integrate the attachment structure 148 with the pads 142. The structural portions 145 may or may not be connected to the spacers 144.

The handles 152 may be connected to the attachment structure 148 by fasteners, may be welded into position, or may be connected using any other connection method. In the present embodiment, the handles 152 are connected to the attachment structure 148 using fasteners (not shown).

Figure 4:
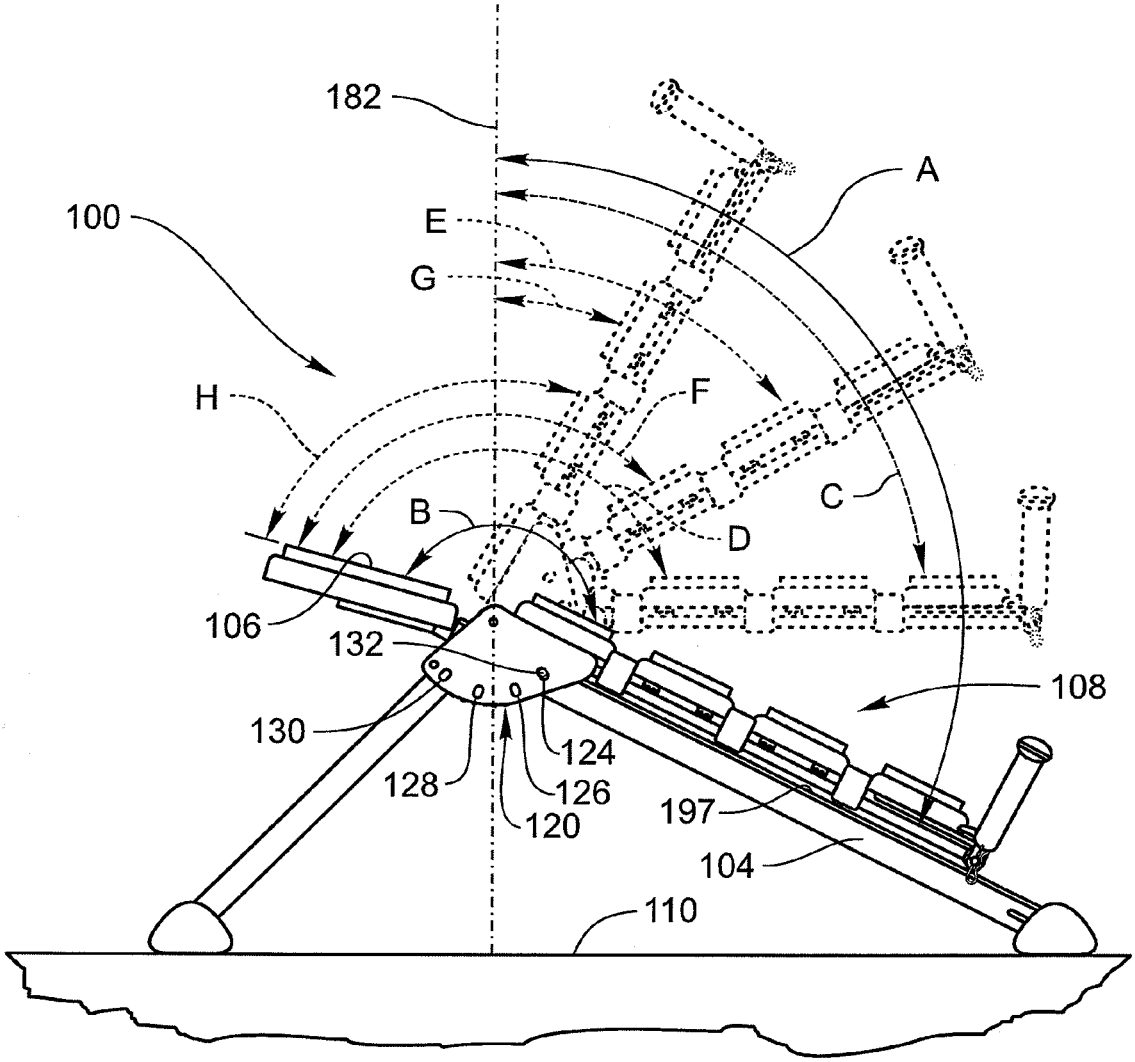
FIG. 4 is a side elevation view of an embodiment of the exercise machine of FIG. 1 showing various exercise positions of the backrest in phantom.

FIG. 4 is a side elevation view of an embodiment of the exercise machine 100 of FIG. 1 showing various exercise positions of the backrest 108. Each of the exercise positions correspond to the various apertures 124, 126, 128, 130 in the bracket 120. The exercise apparatus 100 is shown disposed in a first exercise position that corresponds to the first aperture 124 in the bracket 120 and held in place by virtue of the pin 132. The other exercise positions are shown in phantom. The first position may be used to improve flexibility and for more difficult exercise routines. Additionally, the first exercise position can be a non-use, storage position. Specifically, the backrest 108 is disposed at an angle A from a vertical axis 182 that extends perpendicularly from the surface 110 supporting the exercise machine, such that the backrest 108 generally may abut a top surface 197 of the rear leg 104. Of course, this assumes that the surface 110 is generally flat.

At this first exercise position, the angle A may range from about 105 degrees to about 125 degrees from the vertical axis 182, such that the backrest 108 is in a position below horizontal with respect to the support surface 110. In the present embodiment, the angle A is about 115 degrees from the vertical axis 182, such that the backrest 108 is in a position about 25 degrees below horizontal.

The backrest 108 also extends at an angle B to seat 106. The angle B between the seat 106 and the backrest 108 may range between about 180 degrees to about 200 degrees. In the present embodiment, the angle B between the seat 106 and the backrest 108 is about 190 degrees.

FIG. 4 illustrates the exercise apparatus 100 disposed in a second exercise position, shown in phantom, which corresponds to the second aperture 126 in the bracket 120. The backrest 108 is disposed at an angle C from the vertical axis 182. At this second exercise position, the angle C may range from about 75 degrees to about 105 degrees from the vertical axis 182, such that the backrest 108 ranges from about 15 degrees above or below horizontal. In the present embodiment, the angle C is about 90 degrees from the vertical axis 182, such that the backrest 108 is in a generally horizontal position.

The backrest 108 also extends at an angle D to seat 106. The angle D between the seat 106 and the backrest 108 may range between about 150 degrees to about 180 degrees. In the present embodiment, the angle D between the seat 106 and the backrest 108 is about 165 degrees.

FIG. 4 further illustrates the exercise apparatus 100 disposed in a third exercise position, shown in phantom, which corresponds to the third aperture 128 in the bracket 120. Specifically, the backrest 108 is disposed at an angle E from the vertical axis 182. At this third exercise position, the angle E may range from about 45 degrees to about 75 degrees from the vertical axis 182, such that the backrest 108 is in a position above horizontal. In the present embodiment, the angle E is about 60 degrees from the vertical axis 182.

The backrest 108 also extends at an angle F to seat 106. The angle F between the seat 106 and the backrest 108 may range between about 120 degrees to about 150 degrees. In the present embodiment, the angle F between the seat 106 and the backrest 108 is about 135 degrees.

FIG. 4 also illustrates the exercise machine 100 disposed in a fourth exercise position, shown in phantom, which corresponds to the fourth aperture 130 in the main bracket 120. Specifically, the backrest 108 is disposed at an angle G from the vertical axis 182. At this first exercise position, the angle G may range from about 45 degrees to about parallel with the vertical axis 182, such that the backrest 108 is in a non-vertical position. In the present embodiment, the angle G is about 30 degrees from the vertical axis 182.

The backrest 108 also extends at an angle H to seat 106. The angle H between the seat 106 and the backrest 108 may range between about 90 degrees to about 120 degrees. In the present embodiment, the angle H between the seat 106 and the backrest 108 is about 105 degrees.

Of course, the exercise apparatus 100 may be modified to provide for additional exercise positions that correspond to additional fixed positions between the backrest 108 and the bracket 120. These additional exercise positions should dispose the backrest 108 at an angle ranging from about 20 degrees from the vertical axis 182 toward the seat 106 to about 135 degrees from the vertical axis 182 away from the seat 106. The apertures 124, 126, 128, 130 may be replaced with a slot (not shown). The slot may enable the user to lock the backrest 108 in multiple positions within the slot. For example, the pin 132 may be replaced with a fastener that may clamp the bracket 120 to the frame 101.

Figure 5:
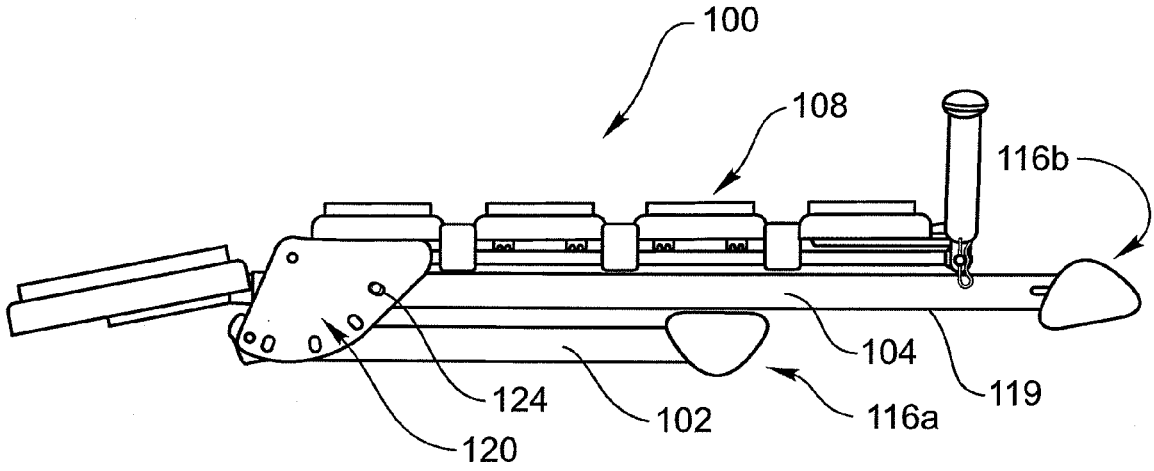
FIG. 5 is a side elevation view of the exercise machine illustrating a non-use, storage mode for the exercise machine.

FIG. 5 is a side elevation view of the exercise machine 100 illustrating a non-use, storage mode of the exercise machine 100. As shown, the backrest 108 has been disposed in the first exercise position which corresponds to the first aperture 124 in the bracket 120. Additionally, the front leg 102 has been folded back toward the rear leg 104. In the present embodiment, the front foot 116*a* nearly abuts the lower surface 119 of the rear leg 104.

As shown, the front leg 102 and the rear leg 104 are generally straight beams in order to minimize the profile of the exercise apparatus 100 in the non-use, storage mode. Of course, the front leg 102 and the rear leg 104 may also be curved to be more aesthetically pleasing, though the exercise apparatus 100 may utilize more room when in its non-use, storage mode.

This non-use, storage mode permits the exercise apparatus 100 to be easily stored in a closet or under or behind furniture, such as a bed, couch, or dresser when the exercise apparatus 100 is not in use. This non-use, storage mode is especially advantageous in small apartments and condos where space is limited. In the present embodiment, the exercise apparatus 100 may be hung from a wall using the rear foot 116*b*.

In summary, an exercise machine for strengthening the abdominal and back muscles of a user includes a backrest for supporting a user's back to prevent injury. The backrest includes flexible members for adjusting the resistance the backrest provides to the user's movements. The backrest is also adjustable in position to control the difficulty of an exercise routine as well as the stress and strain that a user's back and abdominal muscles are subjected to during an exercise routine. The exercise also includes a non-use, storage mode that facilitates storage and makes the exercise machine more accessible because it may be kept at home or in an office where the user is most likely to use the exercise machine.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. An exercise apparatus for use on a base surface by a user comprising:

a foldable frame for supporting a seat above the base surface, said foldable frame being moveable between an exercise mode and a storage mode;

a moveable backrest comprising:

a resilient spine member;

a first end connected to the frame; and a second end that is freely moveable;

wherein said backrest is disposed to provide support to the user's back during movement of the backrest; and a bracket connected to the frame comprising at least one aperture, wherein the bracket is used to adjust the position of the backrest connected to the frame, and wherein at least one of the at least one apertures is configured to position the backrest in a substantially non-vertical position, and a first flexible member disposed adjacent to the resilient spine member and captured by the backrest such that the first flexible member provides a different resistance to the user's movements than the resilient spine member.

2. The exercise apparatus of claim 1, wherein the second end of the backrest twists with respect to the first end of the backrest in response to a threshold torsional force.

3. The exercise apparatus of claim 1, wherein the second end of the backrest moves forward or backward with respect to the first end of the backrest in response to a threshold forward or backward force.

4. The exercise apparatus of claim 1, wherein the second end of the backrest moves side to side with respect to the first end of the backrest in response to a threshold side to side force.

5. The exercise apparatus of claim 1, wherein the second end of the backrest moves forward and backward or side to side while twisting with respect to the first end of the backrest in response to a threshold forward, backward, or side to side force and a threshold torsional force.

6. The exercise apparatus of claim 1, further comprising at least one pad capturing the resilient spine member.

7. The exercise apparatus of claim 1, wherein each of the at least one apertures corresponds to a position that represents a desired difficulty such that the user can select a position and thereby select a desired difficulty.

8. The exercise apparatus of claim 1, wherein one of the at least one apertures is configured to position the backrest in a substantially horizontal position.

9. The exercise apparatus of claim 1, wherein one of the at least one apertures is configured to position the backrest in a position that is below horizontal.

10. The exercise apparatus of claim 1, wherein the exercise apparatus further comprises a handle that is disposed near the second end of the moveable backrest.

11. An exercise apparatus for use on a base surface by a user comprising:

a foldable frame for supporting a seat above the base surface, said foldable frame being moveable between an exercise mode and a storage mode, the foldable frame comprising:

a front leg; and a rear leg that is pivotally attached to the front leg such that the rear leg extends from the front leg at an angle;

a moveable backrest comprising:

a resilient spine member;

a first end connected to the frame; and a second end that is freely moveable, wherein the second end of the backrest moves with respect to the first end of the backrest based on one of the following motions: twisting motions, forward and backward motions, or side to side motions in response to one of the following corresponding threshold forces: a torsional force, a forward or backward force, or a side to side force, and wherein the second end of the backrest moves forward and backward or side to side while twisting with respect to the first end of the backrest in response to a threshold forward, backward, or side to side force and a threshold torsional force, wherein said backrest is disposed to provide support to the user's back and neck during movement of the backrest; and a bracket connected to the rear leg comprising at least one aperture, wherein the bracket is used to adjust the position of the backrest connected to the rear leg, and wherein at least one of the at least one apertures is configured to position the backrest in a substantially non-vertical position.

12. The exercise apparatus of claim 11, wherein each of the at least one apertures corresponds to a position that represents a desired difficulty such that the user can select a position and thereby select a desired difficulty.

13. The exercise apparatus of claim 12, further comprising a first flexible member disposed adjacent to the resilient spine member and captured by the backrest such that the first flexible member provides a different resistance to the user's movements than the resilient spine member.

14. The exercise apparatus of claim 13, wherein the exercise apparatus further comprises a handle that is disposed near the second end of the moveable backrest.

15. An exercise apparatus for use on a base surface by a user comprising:

a frame for supporting a seat above the base surface comprising:

a front leg; and a rear leg that is pivotally attached to the front leg by a pin joint such that the rear leg extends from the front leg at an angle in the range of about 100 degrees to about 110 degrees, wherein the rear leg further comprises at least one attachment ring for connecting a resistance band to the exercise apparatus;

a moveable backrest comprising:

a resilient spine member;

a first end connected to the frame;

a second end that is freely moveable;

at least one elongate flexible member comprising flexible material to provide resistance to the movement of the user; and wherein said backrest is disposed to provide support to the user's back and neck during movement of the backrest; and a bracket pivotally connected to the backrest comprising at least one aperture, wherein the bracket is attached to the rear leg using a pin through one of the at least one apertures, wherein the bracket is used to adjust the position of the backrest connected to the rear leg, and wherein at least one of the at least one apertures is configured to position the backrest in a substantially non-vertical position;

at least one pad capturing the resilient spine member and the at least one elongate flexible member, wherein one of the at least one pads is attached to the bracket; and a handle that is disposed near the second end of the backrest.

* * * * *